United States Patent [19]

Maxham

[11] Patent Number: 4,614,906

[45] Date of Patent: Sep. 30, 1986

[54] SERIES CIRCUIT REGULATING APPARATUS

[75] Inventor: Kenneth Y. Maxham, Richardson, Tex.

[73] Assignee: Rockwell International Corporation, El Segundo, Calif.

[21] Appl. No.: 751,396

[22] Filed: Jul. 3, 1985

[51] Int. Cl.[4] ..... G05F 1/577

[52] U.S. Cl. ..... 323/267; 323/268; 323/224; 307/36; 361/67; 361/18

[58] Field of Search ..... 323/223–226, 323/266, 268, 269, 270, 274–276, 907; 307/11, 32–34, 36–39, 42; 361/18, 67, 79

[56] References Cited

U.S. PATENT DOCUMENTS 3,295,052 12/1966 Martin ..... 323/224

3,896,368 7/1975 Rym ..... 323/224

FOREIGN PATENT DOCUMENTS 2261624 6/1974 Fed. Rep. of Germany ..... 323/268

OTHER PUBLICATIONS

Andryczyk et al., "A Redundant Regulator Control With Low Standby Losses" NASA Tech. Briefs, Summer 1980, vol. 5, No. 2, p. 157.

*Primary Examiner*—Peter S. Wong

*Attorney, Agent, or Firm*—Bruce C. Lutz; V. L. Sewell; H. Fredrick Hamann

[57] ABSTRACT

Current regulating apparatus for connecting a plurality of different impedance loads in series across a high voltage power source with protection means in the event of the failure in the shorted or open condition of the series connected load portions.

11 Claims, 7 Drawing Figures

SERIES CIRCUIT REGULATING APPARATUS

THE INVENTION

The present invention is generally concerned with electronics and more specifically concerned with reducing total power consumption of a plurality of different amperage loads connected to a single high voltage power source. Even more specifically, it is concerned with means and apparatus for connecting a plurality of loads in series across a high voltage source without encountering reliability or power outage problems due to failure of any portion of the series circuit.

It is known in the prior art, that if a plurality of low voltage loads need to be connected to a single high voltage supply, they can be connected in series with or without a series current regulator, as long as the current requirements of each of the loads are identical. However, if the current requirements of the loads are different, the typical approach is to use a switching type regulator for each of the individual loads across the the high voltage power supply, with each of the regulators and loads being connected in parallel. While this does reduce power consumption, the parts cost of a switching type regulator is considerably higher than the parts cost of a series type current regulator. The series type current regulators connected as individual load regulator units across a power supply cause a large amount of power to be wasted in typical prior art designs.

The present invention utilizes a plurality of series regulators and associated series loads connected in a series configuration across a high voltage supply. A shunt regulator is then used across each combination of a series regulator and associated load. The actuation voltage of the shunt regulator is higher than the minimum voltage requirements of the series regulator and the associated load, such that the shunt regulators are not normally activated. When an open circuit occurs in either the series regulator or its load, the shunt regulator completes the circuit to bypass that portion of the series circuit and allow operation to continue. If a short circuit occurs within the series circuit, either a limiting device must be used to limit the current through the shorted circuit portion, or a circuit opening device, such as a fuse, must be used to again actuate the shunt regulator.

It is thus an object of the present invention to reduce costs and power, while simultaneously increasing reliability of circuitry involving the use of a plurality of low voltage loads of different amperage requirements being supplied from a single high voltage power supply.

Other objects and advantages of the present invention will be apparent from a reading of the specification and appended claims in conjunction with the drawings wherein:

DETAILED DESCRIPTION

Figure 1:
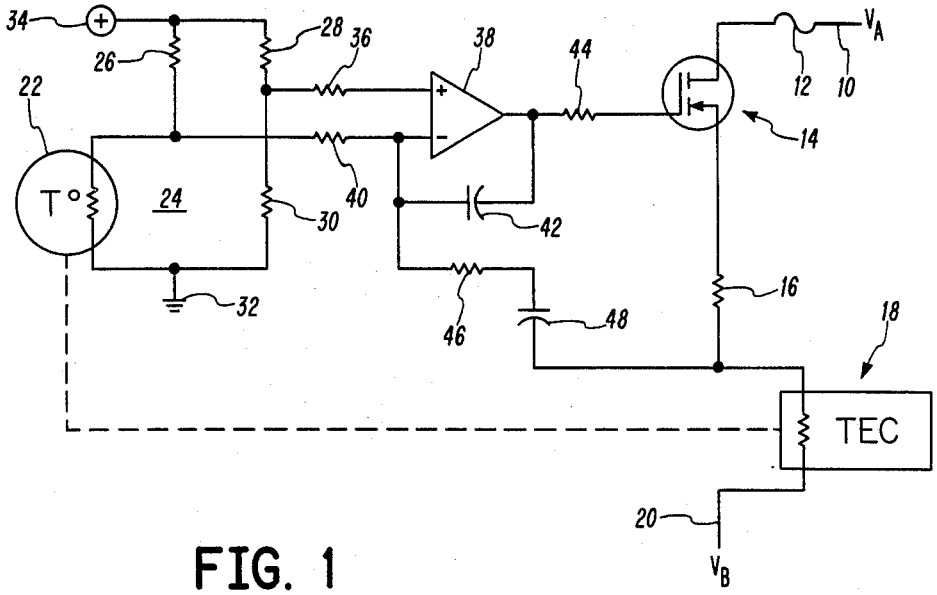
FIG. 1 is a circuit diagram of a specific series pass regulator and TEC (thermoelectric cooler) type load.

In FIG. 1, a first lead labeled $V_A$ and designated as 10 supplies current through a fuse 12 to one terminal of an insulated gate field effect transistor generally designated as 14. In one embodiment of this invention, the insulated gate transistor was an RFP 15N15 from Radio Corporation of America (RCA). However, any gating type device that provides the necessary series regulation can well be used. The other main terminal of gate 14 is connected through a resistor 16 to one lead of a TEC (thermoelectric cooler) load generally designated as 18. The other terminal of TEC 18 is connected to an output lead 20 also designated as $V_B$. The TEC 18 is thermally connected to or in thermal contact with a thermistor generally designated as 22 and forming a leg of a Wheatstone bridge generally designated as 24. The other resistors or resistive elements in Wheatstone bridge 24 are designated as 26, 28 and 30. A junction between thermistor 22 and resistor 30 is connected to ground 32, while a junction between resistors 26 and 28 is connected to a positive power source 34. A resistor 36 is connected at one end to the junction between resistors 28 and 30 and at the other end to a positive or noninverting input terminal of a high gain amplifier 38. A further resistor 40 is connected from a junction between resistive elements 22 and 26 to a negative or inverting input of amplifier 38. A feedback capacitor 42 is connected from output to negative or inverting input of amplifier 38. A resistive element 44 is connected between the output of amplifier 38 and the gate of insulated-gate field effect transistor 14. A further resistor 46 is connected in series with a capacitor 48 between the inverting input of amplifier 38 and the junction between resistor 16 and TEC 18.

Figure 2:
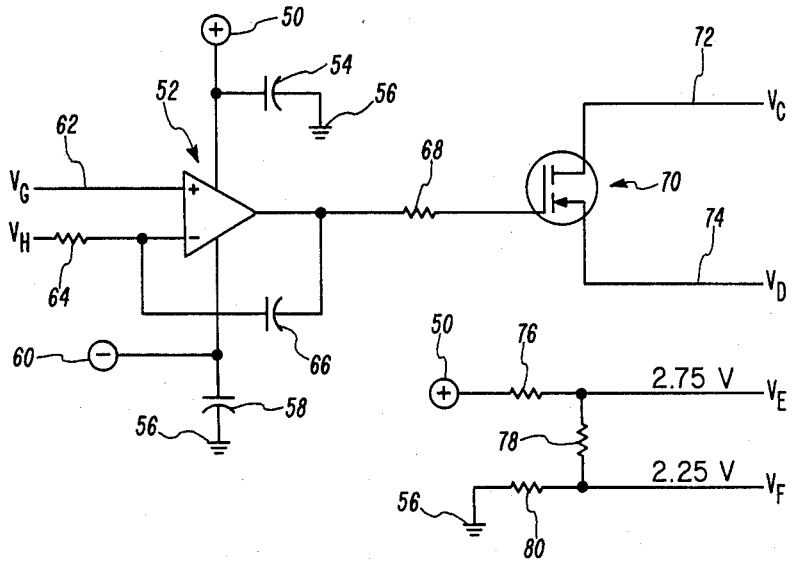
FIG. 2 is a circuit diagram of a specific shunt regulator along with a circuit for providing reference voltages to the shunt regulator.

In FIG. 2, a positive power terminal 50 is connected to supply power to a high gain amplifier 52, and has a capacitor 54 between positive power terminal 50 and ground 56 for filtering purposes. A further filterimg capacitor 58 is connected between ground 56 and a negative power terminal 60, which is also connected to amplifier 52. The positive or noninverting input of amplifier 52 is connected via a lead 62 to other parts of the circuit and is labeled $V_G$ for reference purposes. A $V_H$ label is given to one end of a resistor 64 which has its other end connected to the inverting input of amplifier 52. A capacitor 66 is connected between output and inverting input of amplifier 52. A resistive element 68 is connected between the output of amplifier 52 and the gate of a field effect transistor 70 which may be of the same type as that used in FIG. 1. One output lead of FET 70 is connected via a lead 72 to a point in the circuit labeled $V_C$. The other lead is connected via a lead 74 to a circuit point designated as $V_D$. A positive power terminal 50 is connected through a set of three resistors 76, 78 and 80 to ground 56. Terminals $V_E$ and $V_F$ are brought off these resistors, as shown, wherein $V_E$ provides a reference voltage of 2.75 volts and $V_F$ provides a reference voltage of 2.25 volts in one embodiment of the invention where the total voltage to a module of the type shown in FIG. 5 was 5 volts.

Figure 3:
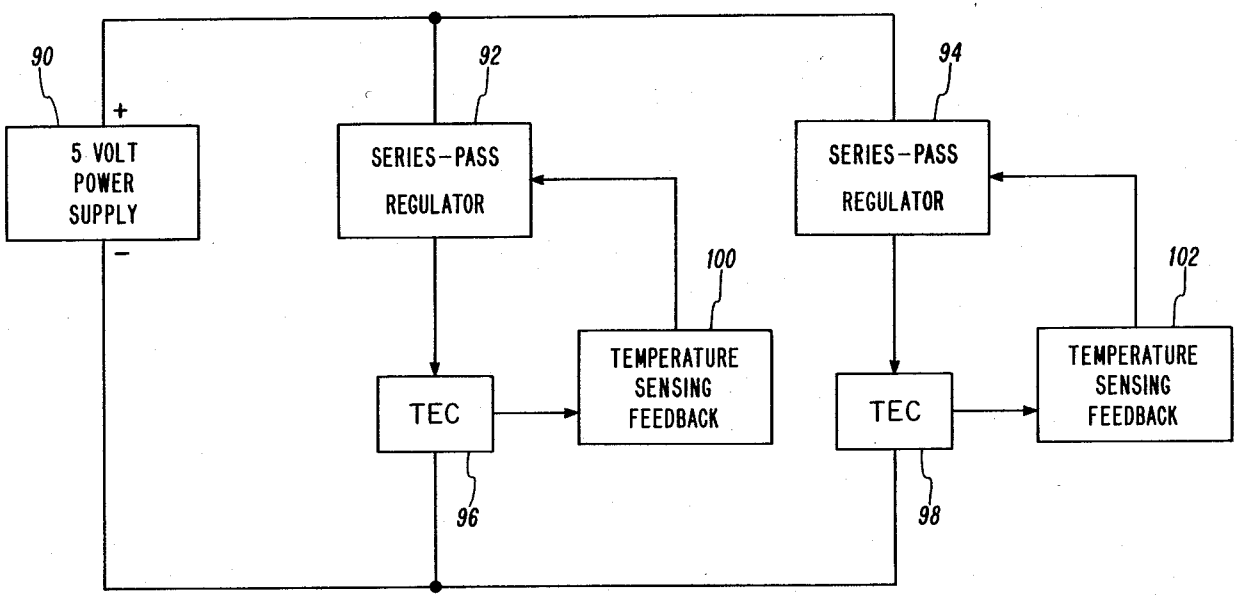
FIG. 3 PRIOR ART
FIG. 3 is illustrative of one prior art approach to using a plurality of different amperage rated loads across a single high voltage power supply.

In FIG. 3, a 5 volt power supply 90 is shown supplying power to a pair of series pass regulators 92 and 94. Each of the series pass regulators has a TEC load connected thereto such as 96 and 98. The two regulators and TEC's are connected in parallel across the positive and negative terminals of power supply 90. Temperature sensing feedback circuits 100 and 102 are connected from the respective TEC's to their associated series regulators as illustrated. This provides a prior art approach to using a plurality of different loads of different amperage ratings or ampacities when wastage of power was not as important as economy of circuit design and component cost.

Figure 4:
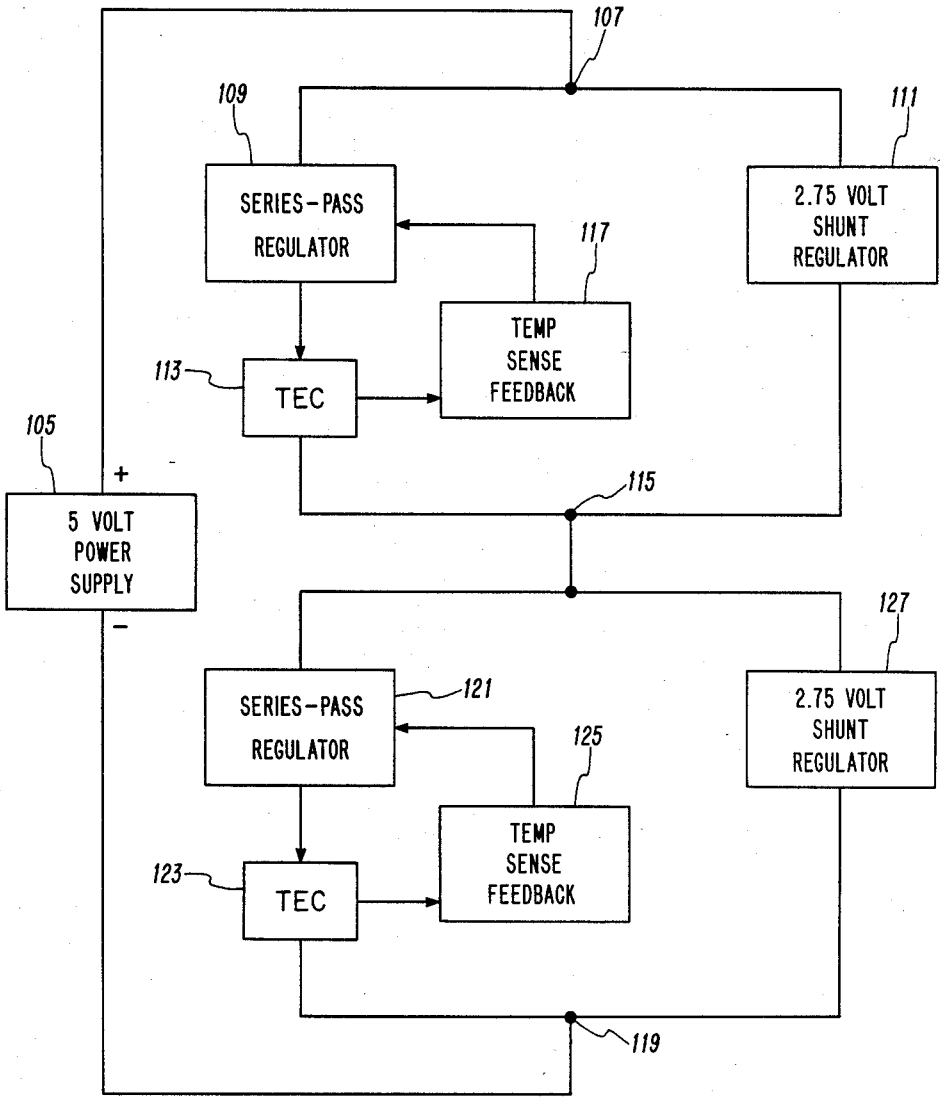
FIG. 4 is a first block diagram showing the concept of the present invention.

In FIG. 4, a 5 volt power supply 105 is shown having a positive power terminal connected to a junction point 107 which supplies current to both a series pass regulator block 109 and to a 2.75 volt shunt regulator 111. Current is supplied through regulator 109 to a load, such as TEC 113, and from there to a junction point 115. Junction point 115 is connected to the other side of shunt regulator 111, and thus shunt regulator 111 is connected in parallel with the combination of regulator 109 and its associated load 113. A temperature sensing feedback circuit 117 is shown providing feedback signals from the TEC 113 to regulator 109. Another set of circuits comprising series pass regulator, associated load and shunt regulator are connected in series between junction point 115 and a further junction point 119 and are designated as illustrated from 121 to 127. Junction point 119 is connected to the negative terminal of the 5 volt power supply 105. The use of specific voltages in this disclosure are not intended to be limiting, but merely to ease the description of operation for a specific embodiment, since the concept will work with any reasonable set of voltages.

Figure 5:
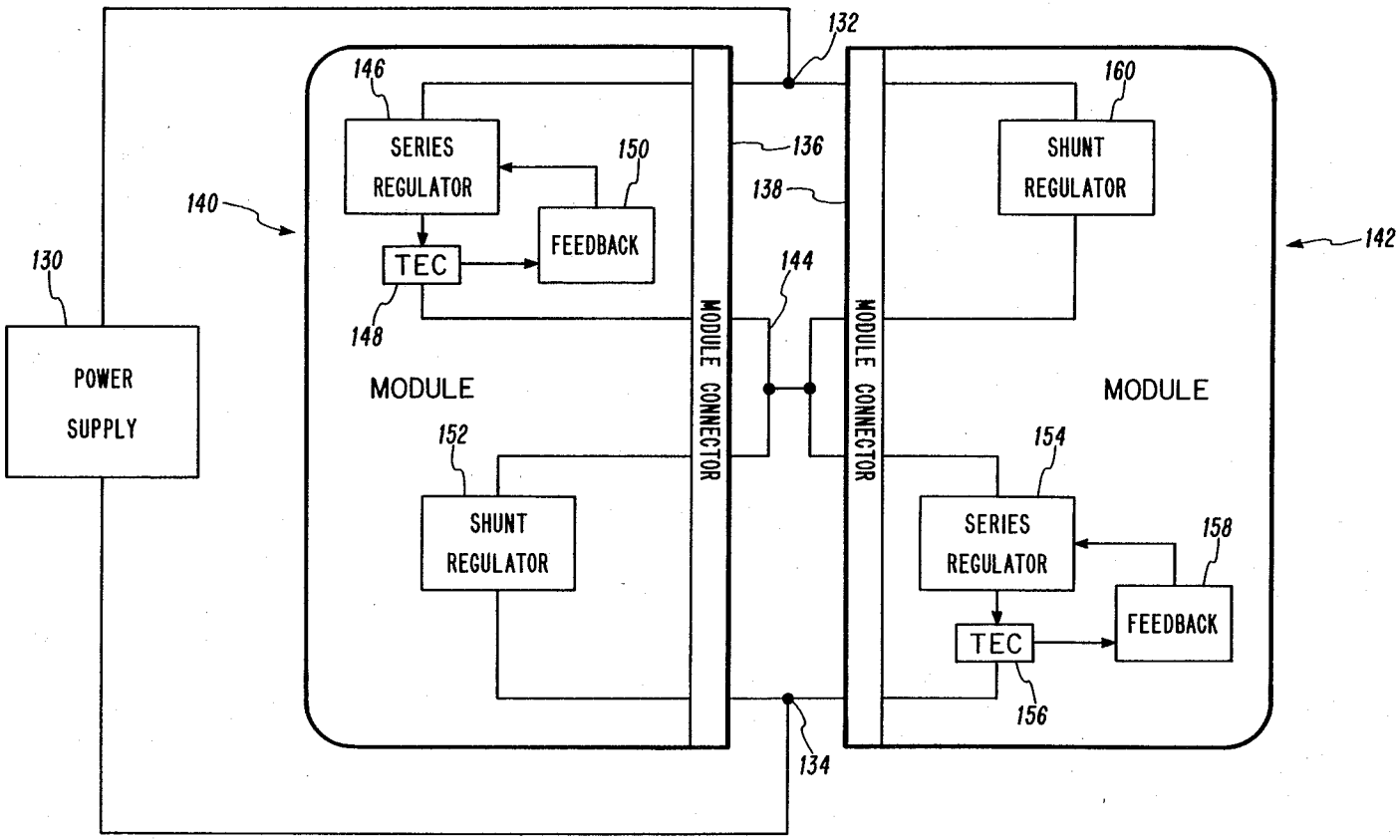
FIG. 5 is a block diagram of the present invention wherein removable identical modules are used to decrease repair time on a replacement concept type basis.

In FIG. 5, a power supply 130 is shown connected to junction points 132 and 134. These two junction points are connected through plug-in type female connector strips 136 and 138 to identical modules 140 and 142. A further set of leads 144 is also connected to each of the connector strips 136 and 138. Within module 140 there is a series regulator 146, a load 148 and a feedback circuit 140. In addition there is a shunt regulator 152. A like set of components is shown in module 140 and are designated from 154 to 160. FIG. 5 is merely a conceptual drawing used for facilitating the process of explaining the inventive concept while FIG. 6 provides a more accurate representation of the modules and shows more readily how they are identically constructed although the illustration of the wiring connection between the connector blocks is decidedly harder to decipher.

Figure 6:
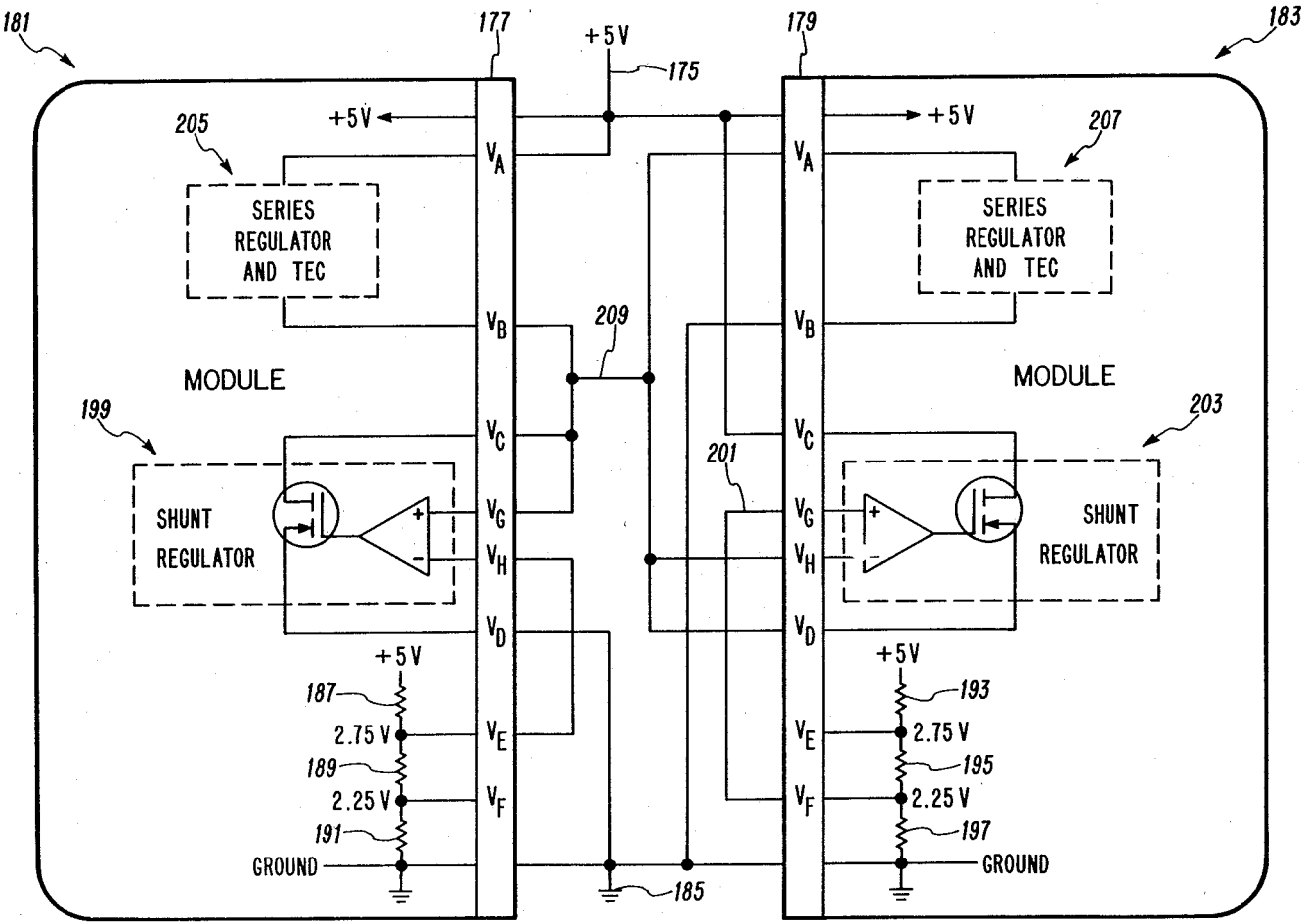
FIG. 6 is a illustration in more detail of the interconnection of the modules of FIG. 5.

In FIG. 6, a positive power supply (such as 5 volts) is connected to a lead 175 which is then connected to several different terminals on plug-in receptacles 177 and 179. Lead 175 provides a positive 5 volts through receptacle 177 to various circuitry within a module generally designated as 181. It provides the same function within a second module 183. In addition, the positive power terminal supplies power to a terminal labeled $V_A$ on the left hand module, while supplying power to a terminal $V_C$ on the right hand module. Ground is labeled as 185 and it is connected to ground terminals on the receptacle connectors 177 and 179, and thus to the modules 181 and 183. In addition, it is connected to the receptacle terminals labeled $V_D$ for the lefthand module and $V_B$ for the righthand module. Within the lefthand module a voltage reference circuit comprising resistors 187, 189 and 191 provides reference voltages at 2.25 and 2.75 volts to terminals $V_E$ and $V_F$. A similar set of resistors 193, 195 and 197 are shown in the righthand module 183. It will be noted, however, that only the 2.75 volt reference applied to the connector terminal $V_E$ of the lefthand module is utilized, and this is connected to $V_H$ to supply a reference voltage to a shunt regulator circuit 199 within module 181. In examining the module 183 on the right, the 2.25 volt output is supplied to terminal $V_F$ as it is on the lefthand module, but it is only this terminal that is connected for the righthand module. This is connected via a lead 201 to terminal $V_G$ and is then supplied to a shunt regulator 203 within module 183. A series regulator generally designated as 205 of module 181 is connected to terminals $V_A$ and $V_B$ of connector block 177. In similar fashion, a series regulator 207 is connected to identical terminals of connector block 179. It will finally be noted that a set of leads designated as 209 connect the remaining terminals together or, in other words, terminals $V_B$, $V_C$ and $V_G$ of connector block 177 and terminals $V_A$, $V_H$ and $V_D$ of connector block 179. An examination of this set of connections will show that the effect is to connect the shunt regulator of the righthand module in parallel with the series regulator of the lefthand module, while connecting the shunt regulator of the lefthand module in parallel with the series regulator and its load of the righthand module as shown in both FIGS. 5 and 6.

Figure 7:
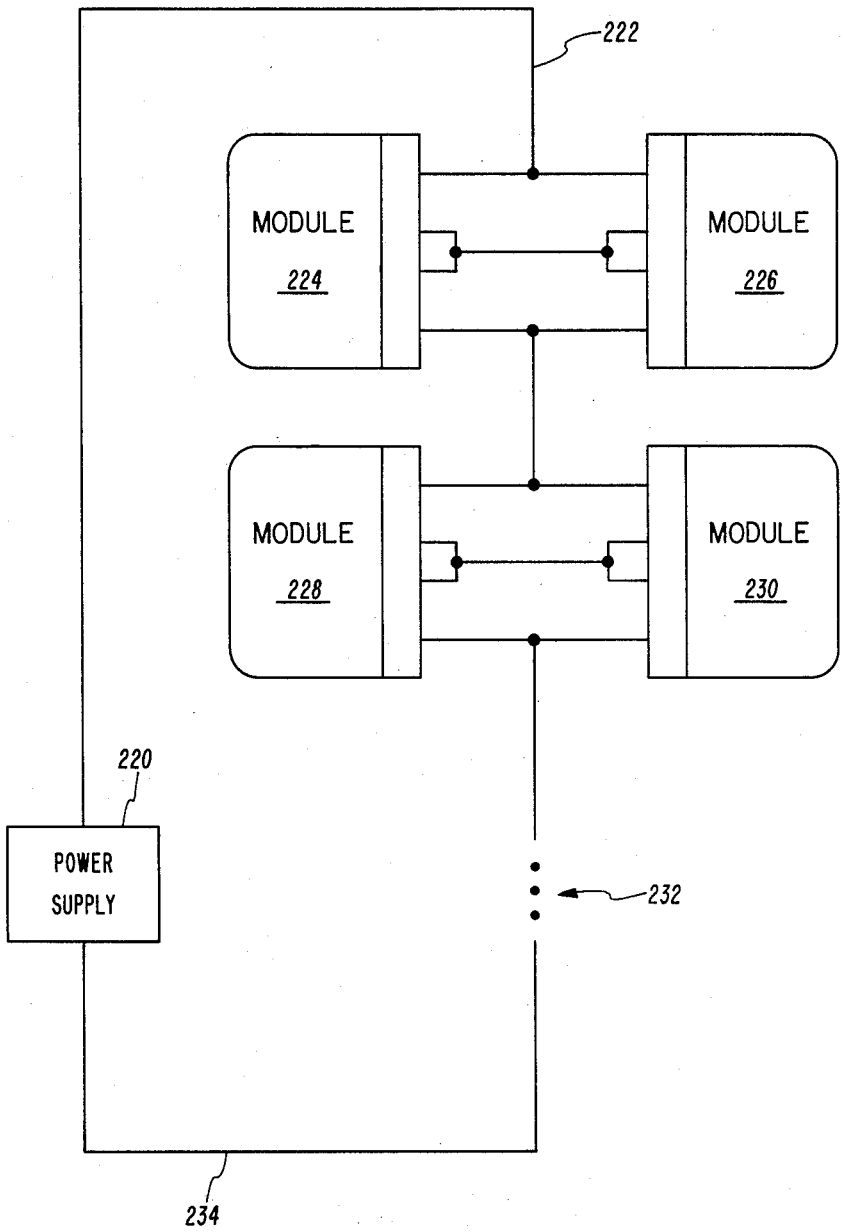
FIG. 7 is a block diagram of the concept of FIG. 5 extended to include a plurality of sets of modules connected across a much higher voltage of power supply.

In FIG. 7, a power supply 220 is shown connected via a lead 222 to one end of a pair of modules 224 and 226. A further pair of modules 228 and 230 is connected in series with the previous pair of modules. Further pairs of modules may also be connected in series with the two pairs illustrated and are shown by the circles 232. The entire assemblage of modules is connected in series across the power supply 220 via the further lead 234. As will be realized, each pair of modules essentially constitutes a combination such as shown in FIG. 6, and if the same components are used, each provides a 5 volt requirement for voltage from power supply 220.

OPERATION

As previously mentioned, economy of power usage, when it is required that low voltage loads be used with a high voltage source, can be obtained by using switching regulators. Such has been accomplished in the prior art. This arrangement is illustrated as in FIG. 3 where the series pass regulators are of the switching type. FIG. 3 illustrates another approach used in the prior art, where a plurality of different current requiring or ampacity loads of low voltage requirements are connected across a high voltage supply. Although 5 volts does not appear to be a very high voltage, the TEC loads typically require only approximately 1 volt. Thus, 4 volts must be dissipated by the associated regulators. Thus, there is a considerable wastage of power in the series regulator 92, if series pass regulators are used with low voltage loads devices.

FIG. 4 illustrates the present inventive concept approach to reducing power requirements, while still economizing on the number of parts and circuit design along with the associated reliability of the circuit. By placing two series regulators, such as 109 and 121, in series with their associated loads 113 and 123 across a 5 volt power supply 105, each of the regulators dissipates the power of only approximately 1.5 volts, as opposed to the 4 volts from FIG. 3 of the prior art. This is not an ideal solution if TEC 113 requires a different amount of current as compared to TEC 123. It is typically the case, however, that TEC's that are not in the exact same environment will require a different amount of current. Thus, the shunt regulators 111 and 127 were connected in parallel with the series regulators and their associated loads. Thus, if the current requirements for TEC 113 become very low, the voltage will rise across the junction points 107 and 115 until the shunt regulator 111 is activated. When this is activated, current is bypassed around the regulator 109 and TEC 113 so as to provide adequate current to load 123. If either the regulator 109 or 113 fails in an open condition, the voltage also rises between terminals 107 and 115, and shunt regulator 113 provides the full load current required by any following loads or shunt regulators, such as load 123 and shunt regulator 127. As will be realized, any shunt regulator used must be capable of supplying the maximum current required by any in the series.

If the load 113 or regulator 109 develops a short circuit, either a fuse must be incorporated somewhere in the connection from 107 through load 113 to terminal 115 to open the circuit, and/or some type of current limiting device must be used to protect the high voltage power supply 105, as well as the circuits connected between terminal 115 and terminal 119. In the same manner, a fuse and/or a current limiting device can be incorporated in shunt regulator 111 to protect the high voltage power supply 105, as well as the circuits connected between terminal 115 and terminal 119. If such protection is not used, there will be considerable power wastage due to the activation of one or more of the remaining shunt regulators in the series circuit, if a short develops causing a high current flow directly from terminal 107 to 115.

For one embodiment of the inventive concept, the following criteria were used in the selection of the value of 2.75 volts for the shunt regulator:

The minimum voltage required for operation of the series regulator and TEC is 2.0 volts.

The (high voltage) power supply is 5.0 volts.

Thus, the upper limit for the shunt regulator is less than or equal to 3.0 volts to assure that not less than 2.0 V appears across the series regulator and TEC.

Thus, the lower limit for the shunt regulator is greater than 5.0 Volts÷2=2.5 Volts, so that the shunt regulators will not conduct through each other.

The value of 2.75 Volts is midway between the upper and the lower limits.

FIG. 5 illustrates the concept of FIG. 4, but provides the improvement of having identical circuit cards 140 and 142 for convenience of repair. (The identical construction of circuit cards will be more apparent in connection with the description of FIG. 6.) As will be noted, shunt regulator 160 is in parallel with the series regulator 146 and 148 while shunt regulator 152 is in parallel with series regulator 154 and load 156. Thus, if regulator 154 were to develop problems, the module 142 can be removed with the shunt regulator 152 taking over the voltage dropping function of regulator 154 and load 156. If there are further problems within regulator 146 or load 148 at the time module 142 is removed, there will, of course, be no regulator 160 to correct these problems. However, it is unlikely that such a situation would occur at the same time that there are problems within module 142. Further, if the module 140 is drawing much less current than normal, and thereby causing the voltage to drop between terminals or leads 134 and 144, it will merely ease the power dissipating requirements for regulator 152.

In examining FIG. 6 in detail, it will be noted that the shunt regulator of module 181 is monitoring the voltage on lead 209 for a rise in the voltage at this point of more that 2.75 volts with respect to ground 185. The shunt regulator 203 in module 183 is checking to make sure that the voltage on lead 209 never becomes lower than 2.25 volts with respect to ground 185. If such were to occur, it would indicate that the voltage across series regulator and TEC load 205 had exceeded 2.75 volts with respect to the positive input terminal 175. Thus, regulator 203 is operating to shunt the TEC within block 205, and shunt regulator 199 is operating to shunt the load within the block 207. As will be noted, each shunt regulator is only apparently using different reference voltage inputs. The reference voltage merely appears different because it is with reference to ground. One regulator (regulator 203) is shunting a load which receives its voltage from the 5 volt power supply connected to lead 175.

As will be obvious from all the previous discussion, the concept can be utilized to connect a plurality of pairs of modules across a high voltage power supply, such as 100 volts or so, from supply 220. An appropriate selection of the shunt regulator voltage would be necessary. The failure of any given module will not adversely affect the rest of the pairs of modules as long as the module pair is still operational. This is because the shunt regulators will provide the current path. This is better than a complete open circuit, but is a restriction. Also, it is a normal situation in the repair of electronic equipment that the period of time from when a failure occurs until it is repaired can be relatively long (hours or days); the amount of time to remove and replace a module is relatively short (minutes). However, the removal of a module, such as 226, will restrict the current flow through the remaining modules to that value required by the series regulator in module 224.

The specific voltages illustrated and specific solid state devices mentioned are merely for illustration and it is to be realized that I do not intend to limit myself to these values. Rather, I wish to be limited only to the concept of using shunt regulators in parallel with associated series regulators and loads across a high voltage power supply to reduce wastage of power while still realizing economy of parts and associated reliability of end product.

I wish therefore to be limited only by the scope of the appended claims wherein I claim:

1. Current regulating apparatus for use with a load which requires a voltage of much less than the voltage of a source comprising, in combination:

power source voltage supply means of a predetermined voltage value having first and second terminal means;

a plurality of shunt regulator means connected in series across said first and second terminal means, each shunt regulator means having a given breakdown voltage, the sum total breakdown voltage value of all of said plurality of shunt regulators being greater than said predetermined voltage value; and a plurality of series regulator circuits each connected in parallel with a corresponding shunt regulator means wherein each of said plurality of series regulator circuits includes, a series pass current regulator means, a current using load means, and feedback means from the load means to the series pass current regulator means for regulating the current supplied to said load means.

2. Apparatus as claimed in claim 1 wherein said load means is a thermoelectric cooling means.

3. Apparatus as claimed in claim 1 wherein the operational voltage requirements of each of said series regulator circuits is less than the given breakdown voltage of the shunt regulator means to which it is parallel connected.

4. A method of connecting a plurality of series pass current regulators and their associated loads in series across a high voltage power source whereby failure of an individual regulator or load does not prevent operation of the rest of the loads comprising the single step of:

connecting shunt regulator means, each having a given minimum breakdown voltage, in parallel with the series pass current regulators whereby the sum of the given minimum breakdown voltage is greater than the voltage available to the parallel connected series pass current regulators and their associated loads from said high voltage power source.

5. A method of increasing repairability of a set of series pass regulator circuits and their associated loads connected to a single high voltage power source using a plurality of identical modules each comprising first a series pass regulator circuit and associated load connected to first and second terminal means and second a shunt regulator connected to third and fourth terminal means comprising the steps of:

connecting first and second sets of the modules in series across a high voltage source whereby each module in said first set is paired with a like module in said second set;

connecting said first and second terminal means of each module in said first set to said third and fourth terminal means of its paired module in said second set whereby a series regulator and associated load of a module in said first set is connected in parallel with a shunt regulator in said second set;

connecting said third and fourth terminal means of each module in said first set to said first and second terminal means of its paired module in said second set whereby a series regulator and associated load of a module in said second set is connected in parallel with a shunt regulator in said first set; and connecting together each of said second and third terminal means of each of the modules in said first set of modules, removal of any given module causing activation of the shunt regulator circuit of the paired module without causing further interruption of circuit operation.

6. A method of connecting a plurality of different current carrying capacity loads in series across a high voltage power source while maintaining operation during failure of a given load comprising, the steps of;

connecting each load in series with a series current regulator for that individual load;

connecting a set of loads and associated series current regulators in series between output terminals of a high voltage power source; and connecting a shunt regulator in parallel with each series connection of a load and it's series current regulator, an individual shunt regulator having a higher voltage rating than the combined voltage requirements of its associated series load and series current regulator, and the sum of the voltage ratings of all the shunt regulators connected in series being greater than the voltage of the high voltage power source.

7. A method of modularly repairing apparatus each comprising a series load and a series current regulator connected in parallel with a shunt regulator without interrupting the operation of presently operable loads comprising, the steps of:

a first set of modules in series across a high voltage power source wherein each module has a series regulator and associated load with plug-in terminals and then has a shunt regulator with plug-in terminals;

connecting a second set of complementary but identical modules to those in the first set in series across said high voltage power source; and cross connecting the plug-in terminals of each shunt regulator in each module in parallel with the plug-in terminals of the series regulator and associated load in its complementary module whereby the removal of any one module for repair activates the shunt regulator in the complementary module and thus leaves system apparatus having a complete electrical connection for current flow between terminals of the high voltage power source.

8. High reliability current regulating apparatus comprising, in combination:

a first plug-in circuit module comprising first a series pass regulator circuit and associated load connected to first and second terminal means of the module and second a shunt regulator connected to third and fourth terminal means of the module;

a second plug-in circuit module comprising first a series pass regulator circuit and associated load connected to first and second terminal means of the module and second a shunt regulator connected to third and fourth terminal means of the module;

high voltage power source means including first and second power terminals;

means for connecting said first and second circuit modules in series across said high voltage source means; and further means for connecting the modules together electrically wherein the shunt regulator of one module is electrically connected in parallel with the series pass regulator and associated load of the other module of the pair of modules, whereby the removal of either module activates the shunt regulator of the remaining module and does not otherwise affect circuit operation of the remaining module.

9. Apparatus for connecting a plurality of series pass current regulators and their associated loads in series across a high voltage power source whereby failure of an individual regulator or load does not prevent operation of the rest of the loads coaprising, in combination:

a high voltage power source;

a plurality of series pass current regulators and their associated loads connected in series across said power source;

a plurality of shunt regulators, each having a given minimum breakdown voltage; and means connecting a shunt regulator means in parallel with each series pass current regulator whereby the sum of the given minimum breakdown voltages is greater than the voltage available to the parallel connected series pass current regulators and their associated loads from said high voltage power source.

10. Apparatus for decreasing power requirements for providing low voltage regulated current from a high voltage power supply to a plurality of loads having different regulated current requirements comprising, in combination:

first means for providing a high voltage source of power;

a plurality of loads each including its associated series regulator circuit means connected in series to said first means, each individual load and associated series regulator means having a minimum required voltage for operation; and a shunt regulator means connected in parallel with each combination load and associated series regulator means, the shunt regulator means preventing the passage of a substantial amount of current therethrough until a voltage appears across same which exceeds the minimum required voltage for its parallel connected circuitry.

11. Apparatus as claimed in claim 10 comprising in addition, means included in said series regulator and load circuit for limiting current flow therethrough in the event of a short circuit.

* * * * *